United States Patent [19]

Bratschi

[11] 4,102,381

[45] Jul. 25, 1978

[54] STRIP CURTAIN

[75] Inventor: Konrad Bratschi, Muri, Switzerland

[73] Assignee: K. Bratschi, Silent Gliss, Muri, Switzerland

[21] Appl. No.: 820,135

[22] Filed: Jul. 29, 1977

[30] Foreign Application Priority Data

Aug. 4, 1976 [CH] Switzerland ..... 9959/76

[51] Int. Cl.[2] ..... E06B 9/30

[52] U.S. Cl. ..... 160/168 R; 160/172; 160/176 R

[58] Field of Search ..... 160/166–178 R

[56] References Cited

U.S. PATENT DOCUMENTS

| | | | |
|---|---|---|---|
| 2,605,825 | 8/1952 | Armstrong | 160/172 |
| 2,768,679 | 10/1956 | Kiefer | 160/172 |
| 3,054,446 | 9/1962 | Cayton | 160/173 |
| 3,299,943 | 1/1967 | Poe | 160/176 |
| 3,862,655 | 1/1975 | Knapper | 160/172 |

*Primary Examiner*—Peter M. Caun

*Attorney, Agent, or Firm*—Weiser, Stapler & Spivak

[57] ABSTRACT

A non-stretchable actuating tape moves in the curtain track, engaged by a sprocket wheel attached to the pivot shaft of each sliding element supporting a curtain strip. A slip coupling and stop member limits pivoting. A beaded chain limits spacing of sliding elements.

12 Claims, 12 Drawing Figures

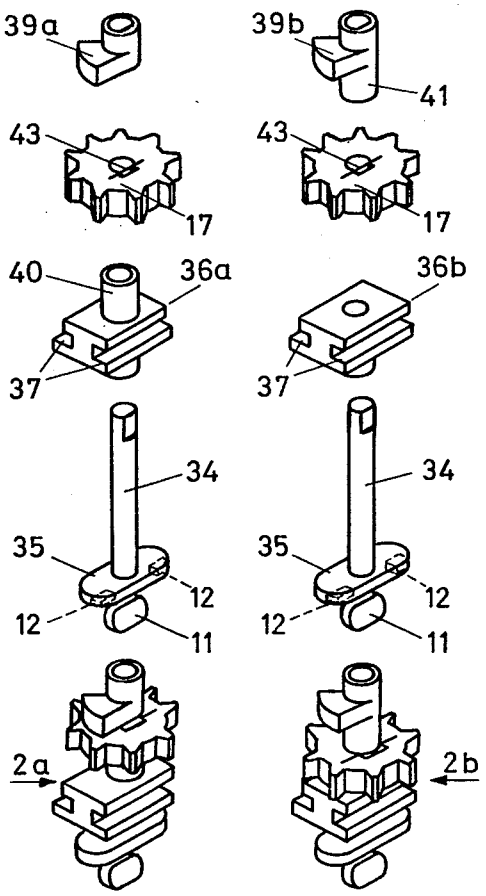
Fig. 5
Fig. 4
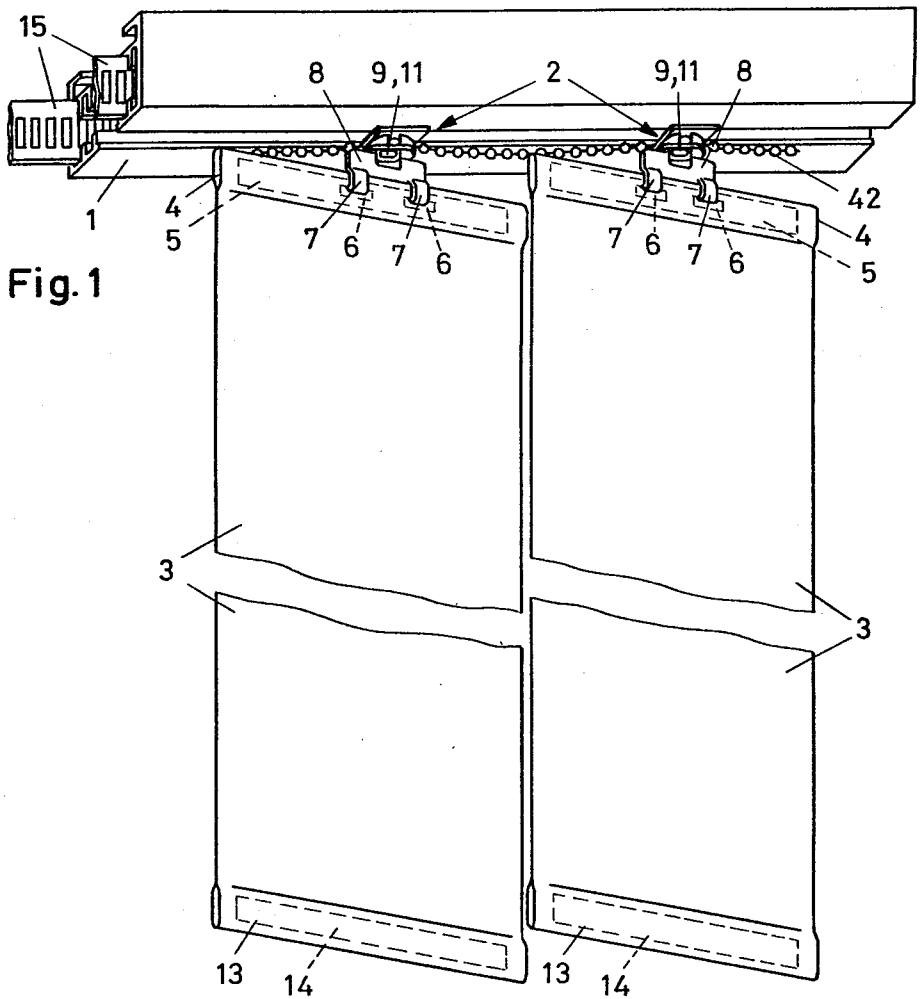
Fig. 1

Fig. 3
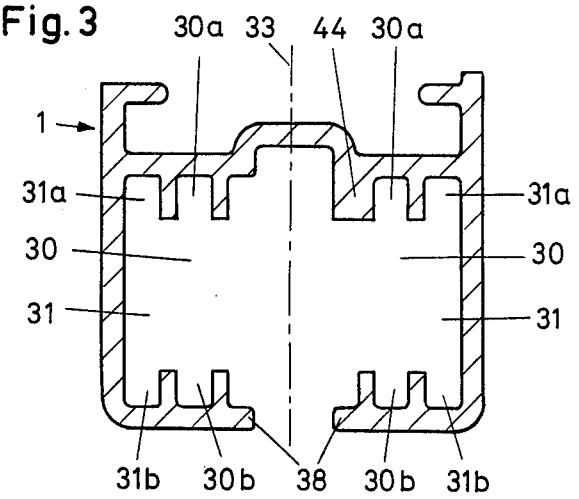
Fig. 6
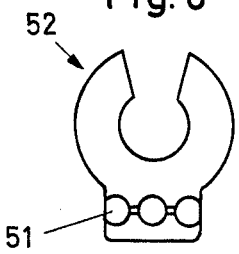
Fig. 7
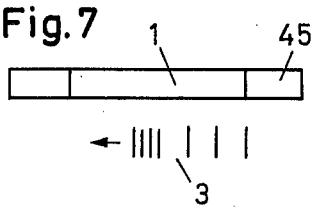
Fig. 8
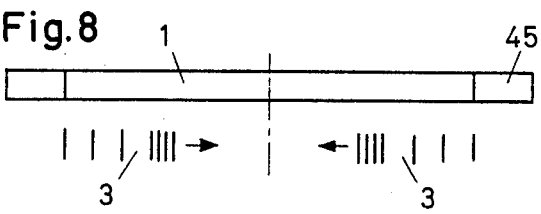
Fig. 9
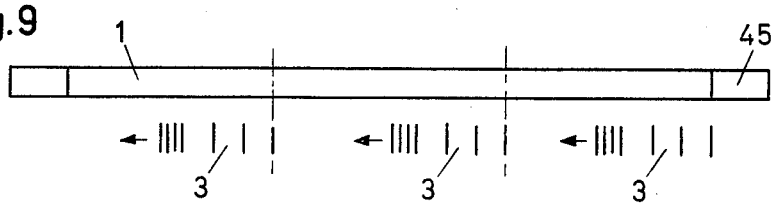
Fig. 10
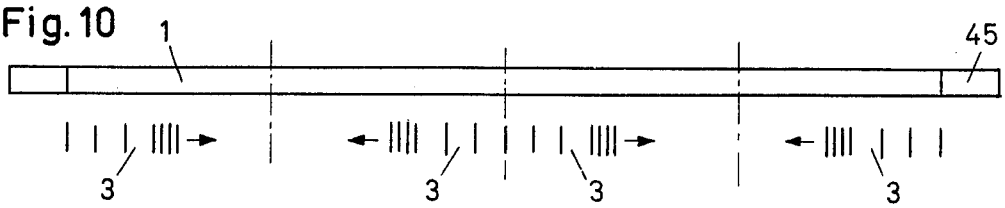
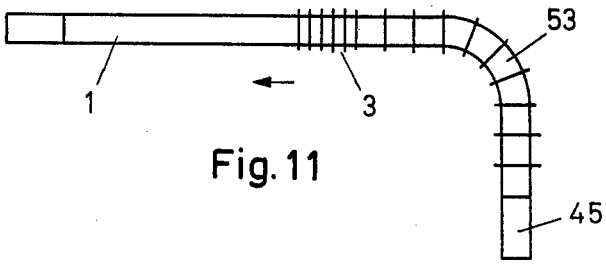
Fig. 11

STRIP CURTAIN

The invention relates to a strip curtain having sliding elements interconnected by means of a flexible distance determining element and guided by a curtain track, to which freely hanging curtain strips are tiltably or pivotably attached, and in which the curtain panels or strips are operable by means of an actuating tape movably positioned within the curtain track.

Strip curtains or vertical venetian blinds are known in a wide variety of constructions, such as scissor frames guided in curtain tracks in the elements of which the individual vertical panels are suspended. The scissor frame arrangement, however, is complicated and aesthetically unsatisfying. In other strip curtains the individual vertical panels are suspended by drawstrings in longitudinally displaceable and pivotable relationship to the curtain track. This has the drawback that the individual strips which are progressively farther from the operating end close non-uniformly due to stretching of the drawstrings. As a result, control of light transmission can no longer be achieved satisfactorily.

In systems in which the strips are positively driven through spindles housed in the curtain track, these curtain tracks and actuating mechanisms are relatively voluminous and the mechanism is costly and subject to breakdowns. Practically all known arrangements require two elements for their operation, one mechanism for sliding movement and one for rotating movement. Because of this, motorized operation has been feasible only at high cost.

Moreover, in known systems, the guidance of the panels along curves has been impractical, thereby imposing serious limitations on the range of applicability of these systems.

Accordingly, it is an object of this invention to overcome the shortcomings of previously known systems and to provide a strip curtain which is simple in construction and inexpensively producible.

It is another object to provide such a strip curtain in which the problem-free movement of the curtain panels around curves is possible.

It is another object to provide an arrangement into which motorized operation can be conveniently integrated.

These objects and others which will appear are achieved in accordance with the present invention by attaching to the vertical pivot axis of each sliding element a sprocket wheel which is in permanent engagement with the actuating tape. The sliding element has a slip coupling and projections limiting the pivoting of the curtain panels.

This arrangement makes it possible to use a single actuating element to cause the curtain strips to both slide within the curtain track as well as to pivot at any given location. It is also possible for the first time to lead the curtain strips around curves and to pivot them within the curves. A preferred embodiment of the invention thereby makes provision for the curtain track to incude at least one curved track segment.

For further details reference is made to the discussion which follows in light of the accompanying drawings wherein:

FIG. 1 shows a portion of a strip curtain in accordance with the invention;

FIG. 3 is a cross-section through the curtain track;

FIGS. 4 and 5 show two sliding elements, at the bottom of each Figure in their assembled state, at the top in exploded view;

FIG. 6 is a top view of a clamp for attaching a beaded chain used as a spacing device;

FIGS. 7 through 10 are diagramatic side views of various possible combinations of strip curtain using the same actuating drive;

FIG. 11 is a diagramatic top view of a strip curtain with curved track; and

Figure 2:
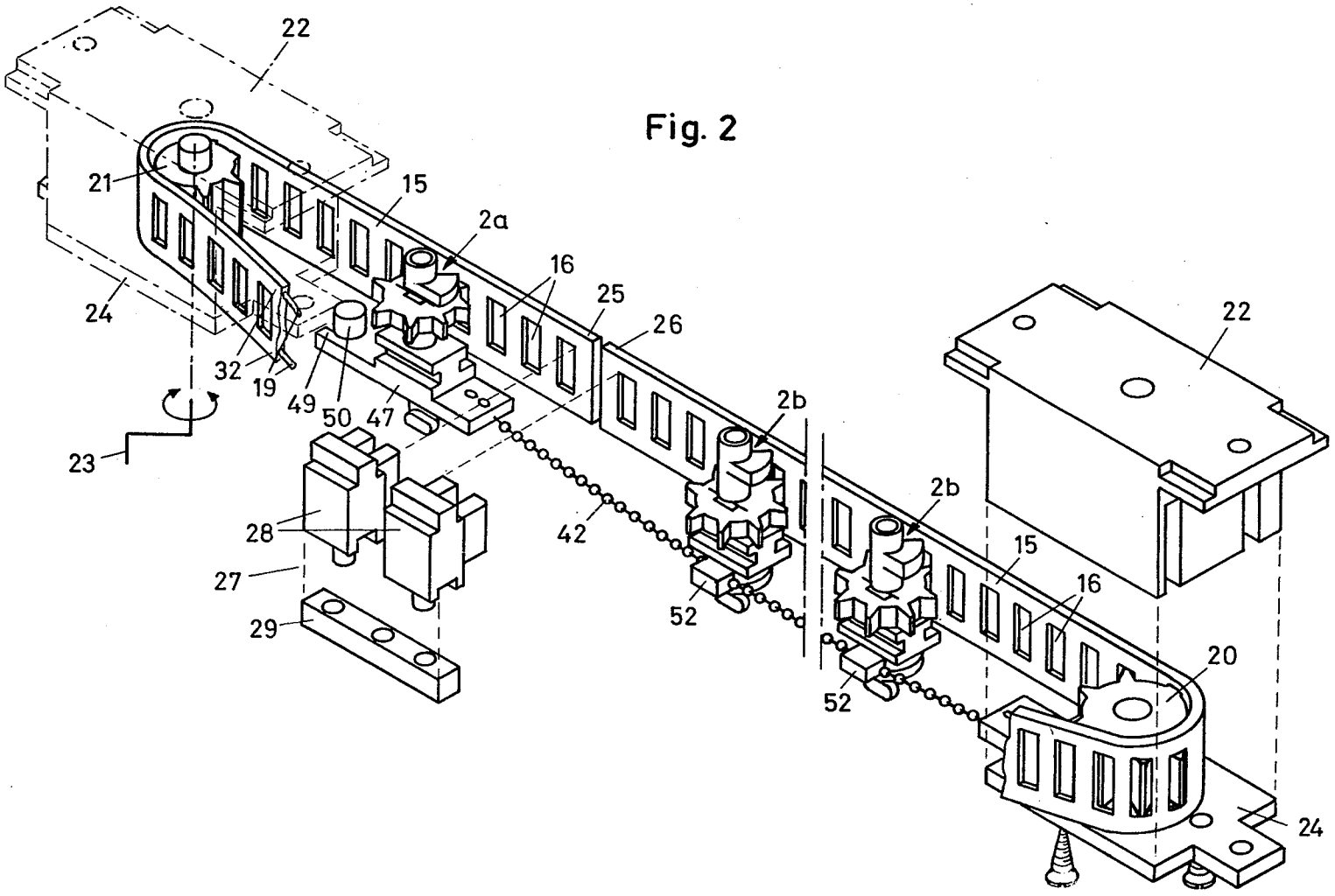
FIG. 2 is a diagrammatic functional illustration of such a strip curtain, in which the various components have been shown separated from each other and the curtain track has been removed for better visibility.

The strip curtain includes a curtain track 1 intended to be attached to the overhead, within which sliding elements 2*a*, 2*b* are guided in longitudinally slidable manner. To the vertical pivot shaft 34 of each sliding element 2*a*, 2*b* a curtain strip 3 is detachably attached in known manner. For that purpose the upper end of the curtain strip 3 is provided with a seam 4 into which there is inserted a longitudinal reinforcing plate 5. Plate 5 has two centrally located apertures 6 into which are engaged two elastic clamping fingers 7 of a synthetic plastic holder 8 which is pressed over the reinforcing plate 5. Holder 8, in turn, is provided with an aperture 9 and two protrusions 10 which cooperate with a corresponding knob 11 and two apertures 12 in sliding elements 2*a*, 2*b*, so as to connect curtain strip 3 in snap-in fashion with the sliding element.

In order that the individual curtain strips 3 hang properly when mounted, weighting plates 14 are inserted into bottom seam 13.

Because the curtain strips are easily snapped in, cleaning and repairs are facilitated and changing needs of room configuration can be accommodated by interchange of strips. These may, for example, be made of synthetic or textile material or of plexiglas.

Within curtain track 1 there is housed an actuating tape 15 which is connected to the sliding elements 2*a*, 2*b*. As appears from FIG. 2, actuating tape 15 is provided with apertures 16 whose long dimension is transverse to the length of the tape. Pinions 17 engage these extended apertures 16. The actuating tape 15 is preferably of synthetic plastic, e.g. polypropylene, and is reinforced at edges 32 with a steel strand 19. This causes the tape to be flexible and yet entirely free of stretch, which is important for uniform displacement of the curtain strips.

Tape 15 is closed on itself and is lead at both ends of curtain track 1 around toothed turn-about rollers 20, 21. The turn-about rollers 20, 21 are positioned within housing 22 arranged at the ends of curtain track 1 and closed by a cover 24. The turn-about rollers can be operated by a crank 23 or by a motor (not shown). The drive may be applied at one or the other end of the curtain track 1. For heavier loads, a motor could also be applied at each end. To prevent damage to the curtain under overload, the turn-about rollers could also be provided with slip couplings.

The ends 25, 26 of actuating tape 15 are connected to each other by a multi-part tape coupler 27 consisting of two grippers 28 and a connecting member 29 (FIG. 2).

For guidance of tape 15 within the curtain track 1, the latter is provided on both sides with an inner and outer tape guide 30, 31. These tape guides are positioned symmetrically with respect to curtain track axis 33 and consist of upper and lower longitudinal grooves 30*a*, 31*a* and 30*b*, 31*b*, within which the edges 32 of actuating tape 15 are guided. The distances of tape guides 30, 31 from curtain track axis 33 are so chosen that the portion of actuating tape 15 which follows the inner tape guide 30 engages pinions 17 of the sliding elements, whereas the portion of actuating tape 15 running within the outer tape guide 31 is out of engagement with pinions 17.

The curtain track 1 is preferably made of light metal and is extruded, narrower and of lower height than known channels with built-in drive mechanisms. It can readily be built into narrow grooves within wood panels or it can be mounted on the overhead, known attaching means being usable to fasten it in detachable manner to that overhead. Such attachment should not utilize screws within the curtain track.

The individual sliding elements 2*a*, 2*b* include the following components: the pivot shaft 34, at whose lower end there is a cross member 35 and the knob 11 for attachment of the curtain strips, recesses 12 being provided in the bottom of cross member 35 for the protrusions 10 from the synthetic plastic holder 8; a sliding shoe 36*a*, 36*b* freely rotatable about shaft 34, the sliding surfaces 37 of which are intended to slide within the lower longitudinal rail 38 of curtain track 1; the pinions 17 mounted with friction fit on shaft 34 and a stop 39*a*, 39*b* fixedly mounted on shaft 34. The slide shoe 36 of the one sliding element 2*a* is provided with an upper, tubular extension 40 whereas the stop member 39*b* of the adjacent sliding element 2*b* has a lower tubular extension 41. This causes the pinion 17 of the one element 2*a* to be positioned above the pinion 17 of the other element 2*b*. As a result, the elements 2*a*, 2*b* can be brought close together without mutual interference between their respective pinions.

Into curtain track 1 there are then inserted alternately a sliding element 2*a* with higher positioned pinion 17 and a sliding element 2*b* with lower positioned pinion 17. Each sliding element 2*a*, 2*b* is attached to a beaded chain 42 which, in its extended state, determines the appropriate spacing of the elements in the extended state of the curtain.

To connect beaded chain 42 with sliding elements 2*a*, 2*b*, the chain is pressed into the hemispherical recesses 51 within a synthetic plastic clamp 52 (FIG. 6) and the latter is snapped onto the shaft 34 of the sliding elements.

To obtain the friction fit, the pinion 17 has a small steel plate 43 forming a leaf spring which is resiliently pressed against shaft 34 and acts as a slip coupling. In place of this leaf spring, obviously, other suitable slip couplings could be utilized.

By use of the flexible, non-stretchable actuating tape, with one-sided engagement with the sliding elements, and by use of the separation limiting device which is also flexible and non-stretching, it is feasible for the first time to provide curved curtain tracks for strip curtains. Pivoting of the individual strips in the curve is also achieved in trouble-free manner because each strip can be operated in every location.

The strip curtain described above functions as follows.

When the curtain is opened, the curtain strips 3 are drawn together at the side in a small bundle. When crank 23 is turned in order to close the curtain, the actuating tape 15 moves within curtain track 1. In so doing, the portion of tape engaging the pinions 17 first produces pivoting of all shafts 34 of sliding elements 2*a*, 2*b*. This pivotal movement is limited by stop members 39*a*, 39*b* cooperating with inner longitudinal rails 44 of curtain track 1.

Upon further rotation of the crank, the strip bundle is displaced by the actuating tape toward the left as shown in FIG. 2. Upon reaching the distance from one end determined by beaded chain 42, the first sliding element 2*a*, 2*b* stops, then the second, and so on until the entire curtain has been drawn apart and the master slide 47 abuts against the operating end. As soon as a sliding element 2*a*, 2*b* stops in its predetermined position, its pinion 17 engaging the tape turns freely about shaft 34 due to slip coupling 43.

At the end of its path, the master slide 47 snaps with its elastic claw 49 around a post 50 attached to the curtain track. This fixes its location and the separation-determining beaded chain 42 remains extended. This is also conducive to uniform pivoting of all the curtain strips.

Upon drawing back of the curtain, all of the curtain strips 3 first pivot in analogous fashion, after which the elements 2*a*, 2*b* are displaced toward the right to form a bundle. First, claw 49 of master slide 47 again snaps away from the post. It should be noted that the pivoting of the elements can take place at any time at any degree of extension of the curtain by appropriate operation of crank 23.

The utility of this strip curtain is extraordinarily versatile and can be adapted to all window sizes and rooms, as well as to protection from the sun or to purely decorative purposes. Because of the interchangability of the strips, special aestetic effects can be achieved rapidly and without high alteration costs.

With the same drive mechanism, it is possible to construct single unit, multi-unit and curved curtain systems, as shown in FIGS. 7 through 11.

In FIG. 7, there is again shown a single unit embodiment in which the curtain track is again designated with reference numeral 1, the curtain strips with reference numeral 3 and the drive mechanism with reference numeral 45.

Figure 12:
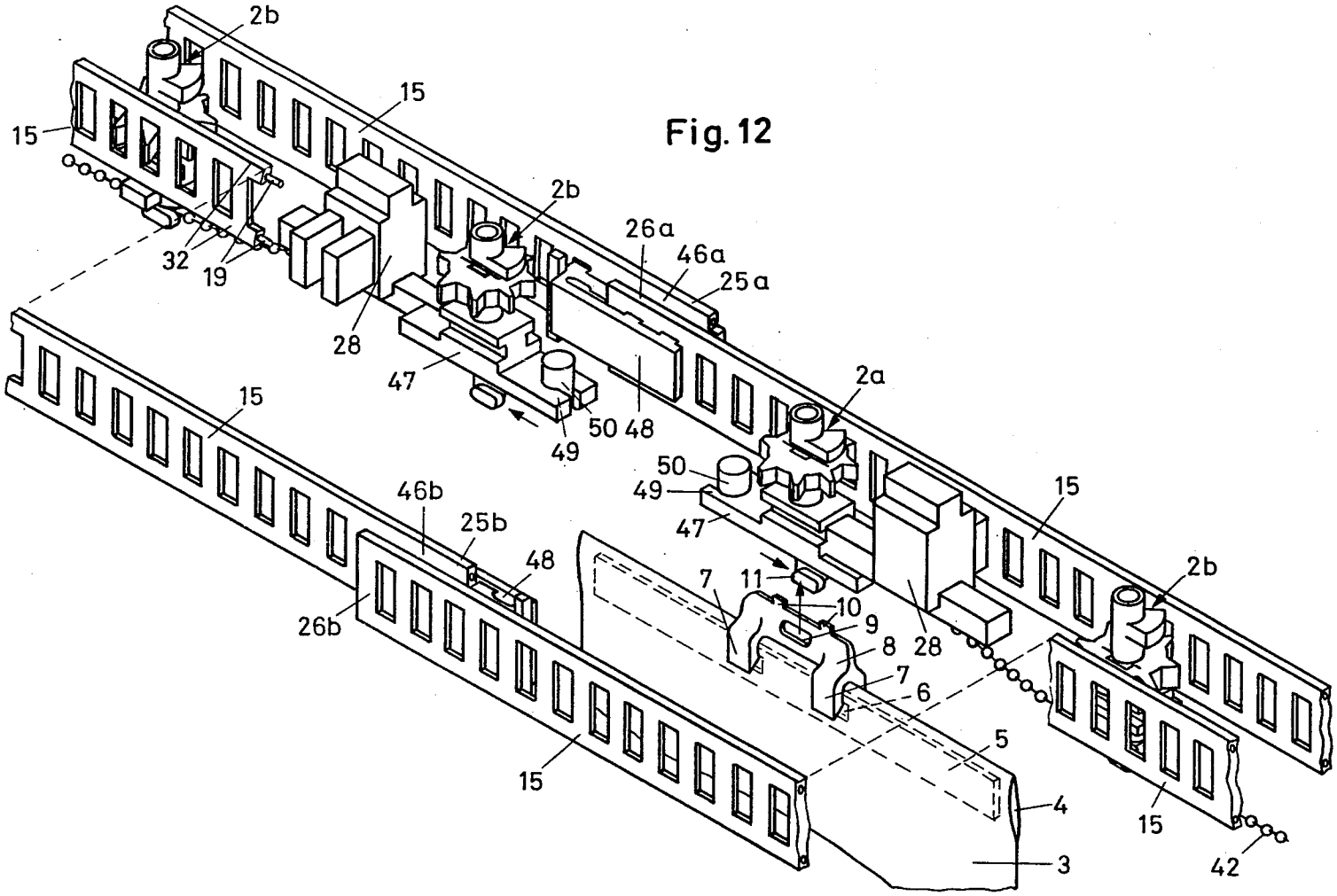
FIG. 12 is a diagramatic illustration of a portion of an actuating tape with the sliding elements, in the vicinity of the connecting link for a 2-part construction of a strip curtain.

In the 2-unit embodiment according to FIGS. 8 and 12, the ends 25*a*, 26*a* and 25*b*, 26*b* respectively of actuating tape 15, are connected to each other with overlap. On the one side, tape 15 is first placed in the inner tape guide 30 and then after overlap 46*a* in the outer tape guide 31. On the opposite side, the tape is first placed in the outer tape guide 31 and after overlap 46*b* in the inner tape guide 30. This has the effect that operation of drive 45 causes the two master slides 47 with their attached sliding elements to move toward each other or away from each other, as the case may be.

In the overlap regions 46*a*, 46*b*, a connector 48 is provided by means of which the overlapping ends 25*a*, 26*a* and 25*b*, 26*b*, respectively, are maintained spaced from one another.

In FIG. 9, three single unit embodiments are hung together in series. Again, only a single actuating tape and a single drive mechanism are needed. In FIG. 10, two 2-unit embodiments are connected together.

FIG. 11 shows a curtain track with a curved track segment 53. The drive mechanism 45 can again be attached to one or the other end of the track. The curtain track could also be assembled from several track segments curves in any desired manner, in which case limits would be set only by the requirement for a minimum radius of curvature.

The strip curtain described above features the following advantages:

The extruded curtain track rail is narrower and less high than known rails with drive mechanisms. Also, the drive housings mounted at both ends have the same width as the track so that the assembly can be placed in narrow grooves. The track is also openly mountable.

The curtain track can be attached to the overhead without screws thereby facilitating repairs or cleaning. Also, removable attachment of the curtain strips to the individual sliding elements is advantageous for the same reasons and from the standpoint of changing room configuration.

By driving with an actuating tape it becomes feasible to guide the sliding elements around curves and to pivot them in the curves. Also, mounting of the strip curtain from a fascia board is readily feasible.

The strip curtain has few components and is therefore more reliable and lower in cost than known strip curtains.

Because of the similar configuration of the end enclosures at both extremities of the curtain track, it becomes feasible to install the drives without additional components at will, at one or the other extremity. To achieve higher loading, a motorized dual drive could be provided, that is one motor could be positioned at each extremity of the track.

The tape is always in engagement with one side of the sliding elements and the strips can be pivoted in any position. Since the tape and the separation limiting device are non-stretching, the tilting takes place uniformly for all the strips.

Because of the vertically displaced arrangement of the pinions for adjacent sliding elements, the latter can be slid close to each other so that the curtain strip bundle uses little room when the curtain is open.

Using only one actuating tape different curtain arrangements can be assembled, consisting of one or more units and curved. This significantly facilitates the guidance and displacement of the strips even with motorized drive.

The curtain strips need not be connected at the bottom, as is necessary, for example, in other vertical slat arrangements. This is advantageous from the decorative standpoint and assures free hanging even when the curtain is closed. However, if such a connection is desired, it can be established without causing problems.

I claim:

1. A strip curtain which includes a curtain track, sliding elements guided in the track and interconnected by a flexible separation limiting means, said sliding elements being adapted to have attached thereto freely hanging curtain strips, and an actuating tape movably positioned within the curtain track, said curtain comprising:

a vertical pivot shaft for each sliding element, a pinion mounted on each pivot shaft, the pinion being in permanent engagement with the actuating tape, and the sliding elements having slip coupling means and stop means limiting the pivoting of the curtain strips.

2. The strip curtain of claim 1 wherein the curtain track has on both sides an inner and outer tape guide, the portion of the actuating tape within the inner tape guide being in engagement with the pinions, and a portion of the tape in the outer tape guide being out of engagement with the pinions.

3. The strip curtain of claim 2 further comprising turn-about rollers at both ends of the curtain track for the actuating tape, and coupling means for linking the ends of the tape into a closed loop.

4. The strip curtain of claim 2 wherein the tape is positioned in the inner tape guide on one side of the curtain track and in the outer tape guide on the opposite side of the curtain track.

5. The strip curtain of claim 1 wherein the curtain track includes at least one curved track segment.

6. The strip curtain of claim 1 wherein the pinion has at least one leaf spring pressing against the pivot shaft whereby the pinion becomes freely rotatable relative to the pivot shaft when a predetermined turning moment of the pinion is exceeded.

7. The strip curtain of claim 1 wherein the actuating tape is made of a flexible synthetic plastic material having steel strands in its edges to prevent its longitudinal stretching.

8. The strip curtain of claim 1 wherein the pinions of adjoining sliding elements are attached in vertical displacement relative to each other.

9. The strip curtain of claim 3 wherein the turn-about rollers are respectively positioned in end portions of the curtain track and at least one of the turn-about rollers is adapted to be connected to a drive mechanism.

10. The strip curtain of claim 9 wherein additional slip coupling means is positioned between the drive mechanism and the actuating tape.

11. The strip curtain of claim 2 wherein the curtain is made of two units with a two-part actuating tape whose respective ends are joined with overlap and maintained spaced by a connecting member, and in front of the overlap the tape is positioned on both sides of the track in one of the tape guides, while behind the overlap the tape is positioned in the other tape guide.

12. The strip curtain of claim 1 wherein a leading sliding element is connected to a master slide having retaining means which is detachably connectable to a fixedly positioned retaining means in the extended state of the separation limiting means.

* * * * *